United States Patent [19]

Powell

[11] 4,133,599

[45] Jan. 9, 1979

[54] SOCKET CONTACT

[75] Inventor: Lloyd J. Powell, Newmarket, Canada

[73] Assignee: International Telephone & Telegraph Corp., New York, N.Y.

[21] Appl. No.: 824,343

[22] Filed: Aug. 15, 1977

Related U.S. Application Data

[63] Continuation of Ser. No. 704,120, Jul. 12, 1976, abandoned.

[51] Int. Cl.[2] ..... H01R 13/12

[52] U.S. Cl. ..... 339/258 R; 339/262 R

[58] Field of Search ..... 339/256, 258, 259, 262

[56] References Cited

U.S. PATENT DOCUMENTS

| | | | |
|---|---|---|---|
| 2,743,428 | 4/1956 | Martines | 339/256 R |
| 2,804,602 | 8/1957 | Vizcarrondo | 339/256 R |
| 2,813,257 | 11/1957 | Cornell, Jr. | 339/258 R |
| 3,155,450 | 11/1964 | Filson | 339/258 R |
| 3,564,487 | 2/1971 | Upstone et al. | 339/258 R |
| 3,634,818 | 1/1972 | Horecky | 339/256 R |

*Primary Examiner*—Joseph H. McGlynn
*Attorney, Agent, or Firm*—A. Donald Stolzy

[57] ABSTRACT

An electrical socket contact comprising a tubular spring member of conductive material having a single longitudinally extending slot from the front to the rear of the member. The side of the tubular member opposite to the slot is joined by a relatively nondeformable connecting section to a rigid body which impart sufficient stiffness to such side so that, upon insertion of a pin contact into the bore in the tubular member having a diameter greater than the bore, the wall of the tubular member will flex at two side regions between the slot and the opposite side of the tubular member. The flexing of the wall of the contact at two side regions thereof provides a highly efficient spring action which is capable of producing high insertion and removal forces.

4 Claims, 10 Drawing Figures

SOCKET CONTACT

This is a continuation of copending application Ser. No. 704,120 filed July 12, 1976 now abandoned. The benefit of the filing date of said copending application is therefore hereby claimed for this application.

BACKGROUND OF THE INVENTION

This invention relates generally to an electrical socket contact and, more particularly, to a spring socket contact capable of producing high insertion and removal forces.

A standard socket contact utilized in the connector industry comprises a tubular member which has a pair of opposed longitudinal slits therein opening at one end thereof, defining a pair of longitudinally extending spring fingers. The spring fingers function as spring beams which resiliently engage a pin contact inserted into the socket contact. Such a contact is disclosed in U.S. Pat. No. 3,564,487. U.S. Pat. No. 3,406,376 discloses a cylindrical socket contact having a single longitudinally extending slot opening at the forward end of the contact. In order to provide adequate spring action for the contact, a section of the wall of the contact is stamped inwardly and folded forwardly for resiliently engaging a pin contact inserted into the socket contact. There is also available in the connector industry a socket contact referred to as a "diaper" contact in which a split cylindrical spring sleeve is mounted on a socket contact body. When the pin contact is inserted into the socket contact, the spring sleeve expands so that a resilient spring engagement is produced between the pin and socket contacts. As will be readily appreciated by those skilled in the art, when the pin contact is inserted into a split cylindrical spring sleeve, the wall of the sleeve will deflect at the side of the sleeve opposite to the slot therethrough. Similar split sleeve contacts operating on the same principle as the diaper contact are disclosed in U.S. Pat. Nos. 2,674,724; 2,917,723; and 3,389,371.

While the foregoing socket contacts are generally suitable, for some applications they do not provide as high a spring engagement with the mating pin contacts as may be required, such as when the contacts are subjected to high vibrations and temperature fluctuations, as encountered in aircraft, for example. Therefore, the purpose of the present invention is to provide a reliable and efficient spring socket contact capable of producing high insertion and removal forces.

SUMMARY OF THE INVENTION

According to the principal aspect of the present invention, there is provided an electrical socket contact comprising a tubular spring member of conductive material having a bore therethrough from the front to the rear of the tubular member. The wall of the tubular member has a longitudinally extending slot therein extending from the front to the rear thereof. To this extent, the socket contact is similar to the diaper pin contact or other split cylindrical sleeve contacts discussed hereinabove. In accordance with the present invention, the side of the tubular member opposite to the slot embodies means imparting sufficient stiffness to such side whereby, upon insertion of a pin contact into the bore having a greater diameter than that of the bore, the wall of the tubular member will deflect at two side regions between the slot and such opposite side. The deflection of the wall of the socket contact at the side regions thereof results in the deflected sides of the contact functioning as independent spring loaded beams, in contrast to the prior art split sleeve socket contact which operates on a "snap ring" type principle in which the arcuate sides of the contact deflect about a common axis. Due to the dual beam loading principle of the socket contact of the present invention, a substantially higher spring engagement is achieved between mating socket and pin contacts with the result that higher insertion and removal forces are obtained so that the contacts are assured of remaining in good electrical engagement with each other even when they are subjected to substantial vibrations and large temperature variations.

DESCRIPTION OF THE PREFERRED EMBODIMENTS

Figure 1:
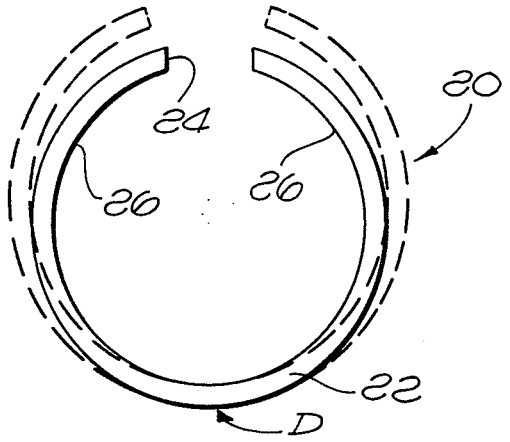
FIG. 1 PRIOR ART
FIG. 1 is a diagramatic illustration of the end of a split sleeve socket contact of the prior art type showing the wall of the contact in both its relaxed and expanded positions.

Reference is now made to FIG. 1 of the drawings, which illustrates an end view of a prior art type split sleeve socket contact 20. The contact comprises a tubular spring member 22 of conductive material having a longitudinally extending slot 24 extending the length thereof. The slot defines a pair of opposed arcuate sidewalls 26. When a pin contact, now shown, having a diameter greater than that of the tubular member 22, is inserted into the socket contact 20, the sidewalls 26 deflect about a single point D on the side of the member 22 opposite to the slot 24, moving to the positions shown in dotted lines in FIG. 1. Thus, the contact 20 is based on a "snap ring" type principle.

Figure 2:
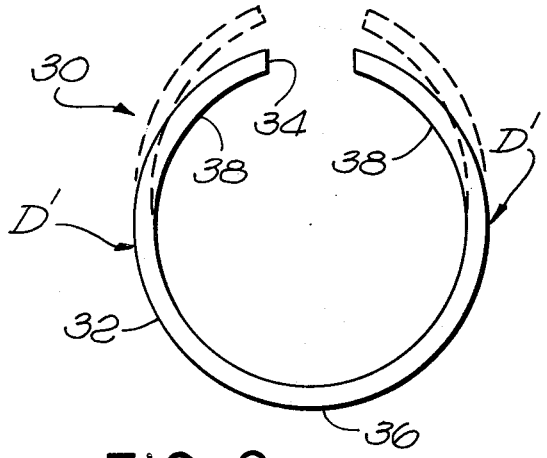
FIG. 2 is a diagramatic illustration similar to FIG. 1 showing the spring contacting section of the socket contact of the present invention in both its relaxed and expanded positions.

Reference is made to FIG. 2 which diagramatically illustrates an end view of the spring contacting section 30 of the socket contact of the present invention. The contacting section comprises a tubular spring member 32 having a longitudinally extending slot 34 extending the length thereof. The side 36 of the tubular member 32 opposite to the slot 34 embodies means, to be described in detail later, which imparts sufficient stiffness to the arcuate sidewalls 38 of the tubular member so that when a pin contact is inserted into the socket contact, the sidewalls will deflect at two side regions D' between the slot and the opposite side 36, as shown in dotted lines in FIG. 2. Thus, in contrast to the prior art socket contact of FIG. 1 in which the sidewalls 26 deflect about a single point D, in the contacting section 30 of the socket contact of the present invention the upper regions of the sidewalls 38 deflect about two points D'. The resiliently shiftable sidewalls 38 of the contact 30 operate on a beam-loading principle which can be shown theoretically, and has been established by empirical data, to yield nominal insertion and removal forces approximately double that of the snap ring prior art socket contact, as illustrated in FIG. 1, assumming equal contact material, cross-section, etc. The contact 30 also produces higher insertion and removal forces than the standard double spring finger socket contacts discussed hereinabove.

Figure 3:
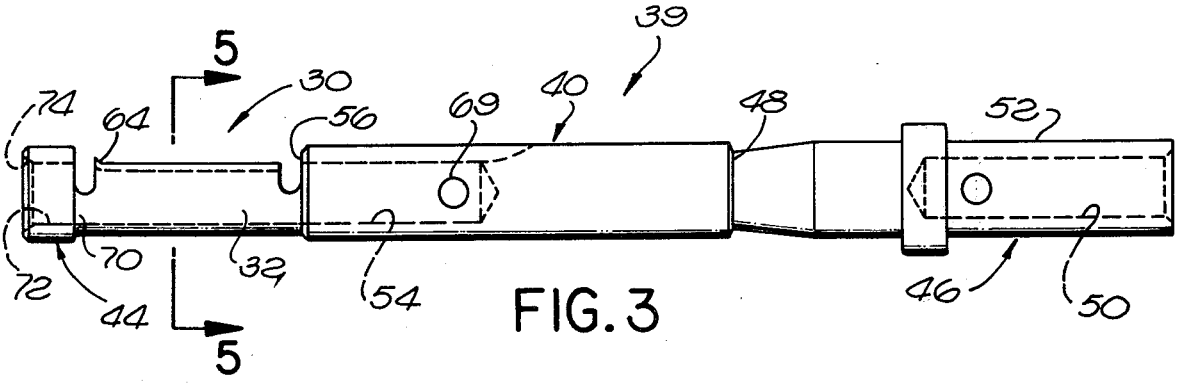
FIG. 3 is a side view of a socket contact in accordance with the present invention embodying a spring contacting section similar to that illustrated in FIG. 2.
Figure 4:
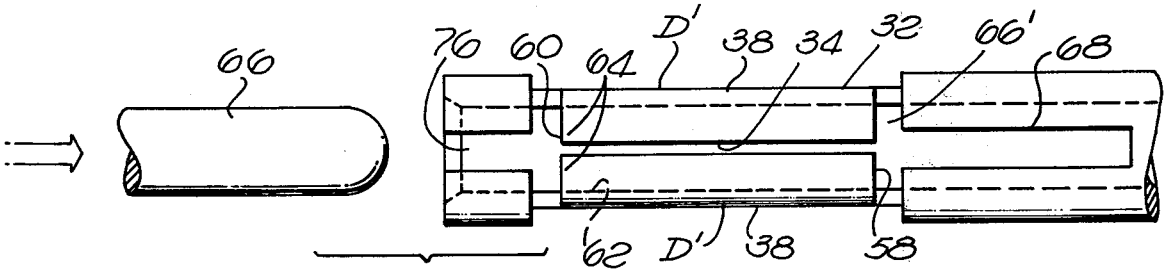
FIG. 4 is a fragmentary top view of the socket contact of FIG. 3 showing the front end thereof with a pin contact positioned to be inserted into the socket contact.
Figure 5:
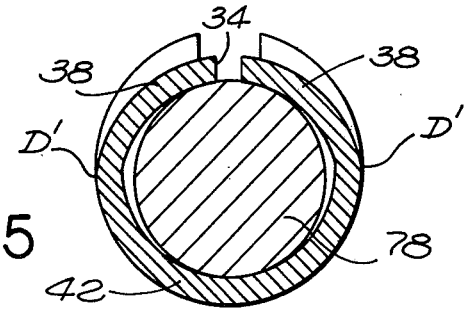
FIG. 5 is a transverse sectional view taken along line 5—5 of FIG. 3 showing the cross-sectional configuration of the spring contacting section of the contact in its relaxed condition, with an arbor pin therein which is used to form said contacting section.

Reference is now made to FIGS. 3 to 5 of the drawings which illustrate in detail the structure of a preferred form of the socket contact of the present invention, generally designated 39. Like reference numerals are utilized in FIGS. 3 to 5 to designate parts corresponding to those illustrated in FIG. 2. The socket contact 39 is fabricated from rod stock and comprises a spring contacting section 30, a rigid cylindrical body 40, a guide ring 44, and a wire termination section 46. The termination section 46 is coaxial with the cylindrical body 40 and is integrally joined to the rear 48 of the body. The termination section contains a rearwardly opening bore 50 which receives the wire (not shown) to be terminated to the contact. The wall 52 of the termination section 46 may be crimped onto the wire in a manner well known in the art.

A cylindrical passage 54 is formed in the body 40 and opens at the front 56 thereof. The spring contacting section 30 comprises a tubular spring member 32 of conductive material similar to that illustrated in FIG. 2. A longitudinally extending slot 34 extends from the rear 58 to the front 60 of the tubular member. The tubular member defines a bore 62 which is generally aligned with the passage 54 in the body 40. Preferably, the forward regions 64 of the sidewalls 38 adjacent to the slot 34 flare outwardly to facilitate insertion of a pin contact 66 into the contacting section 30 of the socket contact.

An arcuate connecting section 66 joins the rear 58 of the contacting section 30 to the front 56 of the rigid cylindrical body 40 of the socket contact. Preferably, the arcuate connecting section has a semi-cylindrical configuration. Due to the arcuate length of the connecting section and its connection to the rigid cylindrical body 40, the connecting section is relatively nondeformable and, therefore, imparts stiffness to the lower half of the tubular spring contacting section 30 of the contact. The connecting section 66' imparts sufficient stiffness to the contacting section so that the sidewalls 38 thereof deflect at the side regions D' when the pin contact 66, having a diameter greater than that of the bore 62, is forced into the contacting section as described previously herein with respect to FIG. 2.

It is seen that a longitudinally extending slot 68 is provided in the body 40 and opens at the front 56 thereof. The slot 68 is aligned with the slot 34. The slot 68 results from a saw cutting operation which is required to longitudinally split the tubular spring contacting section 30 during manufacture. The material of the body 40 is sufficiently rigid so that the slot 68 does not impart any resilience to the body. Since the slot extends beyond the end of the bore 54, it may function as an inspection or drain hole. Alternatively, the slot 68 could be shortened or eliminated and an inspection hole 69 formed in the contact body. As illustrated, the contact embodies both the slot 68 and hole 69.

The guide ring 44 is joined to the front 60 of the contacting section 30 of the contact by means of a second arcuate connecting section 70, which may be identical to the connecting section 66. The wall of the guide ring is preferably sufficiently thick so that the ring is rigid and, therefore, provides protection for the spring contacting section 30 and, together with the arcuate connecting section 70, also imparts stiffness to the lower region of the contacting section to assure that deflection of the sidewalls 38 takes place at the side regions D'. A circular bore 72 extends through the guide ring 44 coaxial with the passage 54 in the body 40. A lead-in chamfer 74 is formed on the front end of the guide ring 44 to facilitate insertion of the pin contact 66 into the socket contact. The diameters of the bore 72 and passage 54 are slightly greater than the diameter of the pin contact 66 so that these passages may slidably receive the pin contact therein. The guide ring 44 has a longitudinally extending slot 76 therethrough which is aligned with the slot 68 in the body 40. Like slot 68, slot 76 is formed by the saw cut used to form the slot through the contacting section 30 of the socket contact. The slot 76 serves no function and may be eliminated.

As best seen in FIG. 5, during the manufacture of the contact, the sidewalls 38 are collapsed upon an arbor pin 78 which has a diameter less than that of the pin contact 66. Thus, the tubular spring member 30 does not have an exactly circular cross-section, and the slot 34 therethrough is narrower than the slots 68 and 76.

Figure 6:
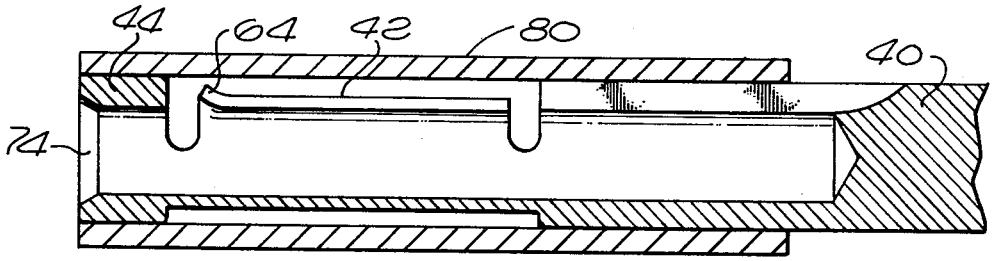
FIG. 6 is fragmentary, longitudinal section through a contact as illustrated in FIG. 3 with a conventional protective hood mounted thereon.

While the guide ring 44 is desirable for protection of the spring contacting section 30 and for facilitating engagement of the pin contact with the socket contact, it may be eliminated assuming that the connecting section 66' imparts adequate stiffness to the full length of the contacting section 30. Reference is made to FIG. 6 which shows a cylindrical hood 80 that is frictionally fitted over the cylindrical body 40 and the guide ring 44. The hood provides protection for the socket contact against probe damage. Alternatively, the guide ring 44 could be a separate piece from the spring contacting section 30 of the contact and could be fixed to or integral with the protective hood 80. The guide ring-hood combination assures that the ring 44 is a closed, inflexible anchor point for imparting stiffness to the lower region of the contacting section 30.

Figure 7:
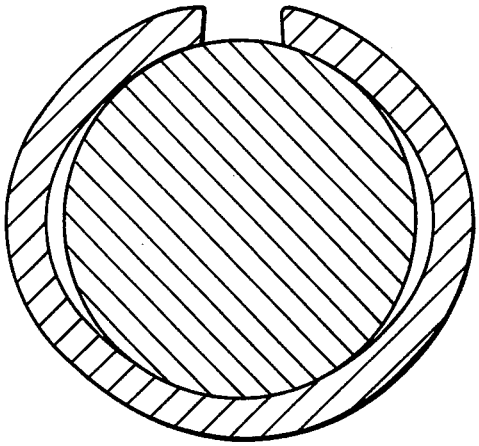
FIG. 7 is a cross-sectional view of the spring contacting section of a contact identical to that illustrated in FIGS. 3 to 5 with a pin contact mounted therein.
Figure 8:
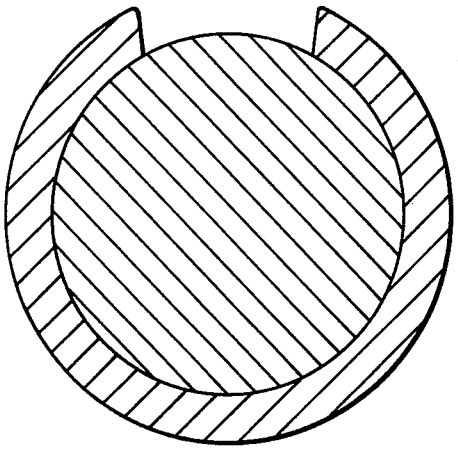
FIG. 8 is a cross-sectional view similar to FIG. 7 illustrating a prior art type split sleeve contact as illustrated in FIG. 1 with a pin contact mounted therein.

Reference is now made to FIG. 7 of the drawings which illustrates a cross-section of the spring contacting section of a socket contact identical to that illustrated in FIGS. 3 to 5, with a pin contact inserted therein. FIG. 7 illustrates how the wall of the socket contact deflects at two regions along the sides of the contact, rather than at the side of the contact opposite to the slot therein. FIG. 8 illustrates a prior art type of snap ring contact, such as described with reference to FIG. 1, formed of the same material and having the same cross-section as the contacting section of the socket contact illustrated in FIG. 7. A brief examination of the drawings will reveal the difference in deflections of the walls of the contacts. The contact of the present invention, illustrated in FIG. 7, has an insertion and removal force of approximately 5 lbs. while the like-dimensioned prior art contact illustrated in FIG. 8 has an insertion and removal force of about 2 lbs. Therefore, it is seen that the insertion and removal force of the contact of the present invention is approximately double that of the prior art contact. As a consequence, the contact of the invention provides a more efficient and reliable spring engagement with a mating pin contact and, therefore, is capable of withstanding greater vibrations and temperature differentials than the prior art contact.

Figure 9:
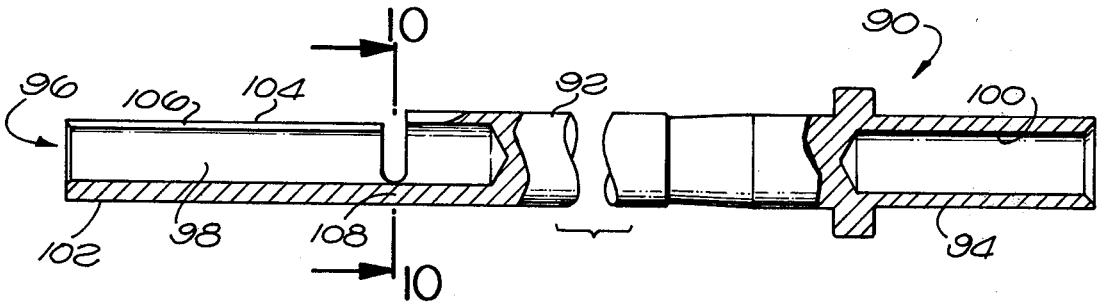
FIG. 9 is a longitudinal sectional view through an alternative form of the socket contact of the present invention.
Figure 10:
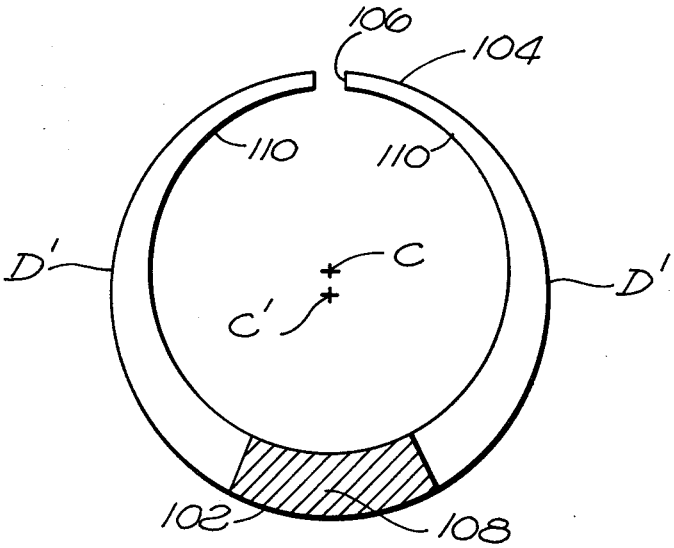
FIG. 10 is a transverse sectional view taken along line 10—10 of FIG. 9.

Reference is made to FIGS. 9 and 10 of the drawings which illustrate an alternative form of the contact of the present invention, generally designated 90. The contact 90 has a rigid cylindrical body 92 and a rear termination section 94 which may be identical to the body 40 and termination section 46 of the contact 39. The spring contacting section 96 extends forwardly from the body 92. The body 92 and spring contacting section 96 have a longitudinally extending bore 98 therein having a center axis C which is offset from the center axis C' of the bore 100 in the termination section 94 of the contact. As a consequence, the thickness of the wall of the contacting section 96 is greater at the lower portion 102 than at the opposite upper section 104. A longitudinally extending slot 106 in the upper section 104 extends to the opposite ends of the contacting section 96. The contacting section 96 is joined to the body 92 of the socket contact by a connecting section 108 which may have an arcuate length substantially less than the connecting section 66 in the contact 39 due to the thickness of the lower region 102 of the tubular contacting section 96. Due to such lower thick region of the contacting section, sufficient stiffness is imparted thereto so that deflection of the sidewalls 110 of the contacting section of the socket contact takes place at points D', as seen in FIG. 10, between the bottom 102 and top 106 of the contact. Alternatively, the contact 90 could be provided with a connecting section 108 having a generally semi-cylindrical configuration, as the connecting section 66', to produce even higher insertion and removal forces.

Besides providing higher insertion and removal forces, and reliable and efficient spring engagements with the mating pin contacts, the socket contact of the present invention has a number of other advantages over prior art split sleeve socket contacts. The one-piece construction provided by the contact of the invention reduces manufacturing and assembly costs. Improved electrical efficiency results from reduced mechanical tolerances and commonality of materials. The contact is rugged and mating contact pressure variations due to differential thermal expansion and elevated temperatures are minimized. Since the central portion of the contact is a solid body, dust and moisture cannot pass therethrough which may effect the integrity of the electrical connection with the mating pin contact. Furthermore, since the body 40 has a uniform outside cross-section, it may be readily sealed in a suitable insulator which is not possible with socket contacts which are longitudinally split along their entire length. Furthermore, by simply varying the arcuate length of the connecting section 66', or the radial thickness of the connecting section 108, a wide range of insertion and removal forces is possible, for example 0.5 lb. to 17 lbs. for a size 16 contact.

What is claimed is:

1. An electrical connector comprising: a pin contact, said pin contact having a circular external surface portion of a predetermined uniform outside diameter therearound; and a hollow tube-like socket contact to receive said pin contact, said socket contact having a longitudinal slot therethrough at one angular position therearound, said socket contact having different stressed and unstressed inside diameters around the approximately symmetrical axis thereof at different angular positions such that when said pin contact is inserted into the interior of said socket contact, said socket contact engages and exerts pressure upon said pin contact at approximately diametrical opposite locations therearound at said one angular position, the unstressed inside diameter of said socket contact at said one angular position being smaller than said predetermined diameter, said socket contact being stressed when said pin contact is inserted thereinto, one inside diameter of said socket contact at a location about 90 degrees from said one angular position being larger than said predetermined diameter when said socket contact is unstressed, said one inside diameter also being larger than said predetermined diameter when said socket contact is stressed and said pin contact is inserted into said socket contact, said socket contact having a notch therethrough at each end thereof transverse to and through said slot, and one member at least at one end of said socket contact fixed thereto, said one member having a stiffness greater than that of said socket contact, another member being fixed to the other end of said socket contact, said other member also having a stiffness greater than that of said socket contact.

2. An electrical connector comprising: a pin contact, said pin contact having a circular external surface portion of a predetermined uniform outside diameter therearound; and a hollow tube-like socket contact to receive said pin contact, said socket contact having a longitudinal slot therethrough at one angular position therearound, said socket contact having different stressed and unstressed inside diameters around the approximately symmetrical axis thereof at different angular positions such that when said pin contact is inserted into the interior of said socket contact, said socket contact engages and exerts pressure upon said pin contact at approximately diametrical opposite locations therearound at said one angular position, the unstressed inside diameter of said socket contact at said one angular position being smaller than said predetermined diameter, said socket contact being stressed when said pin contact is inserted thereinto, one inside diameter of said socket contact at a location about 90 degrees from said one angular position being larger than said predetermined diameter when said socket contact is stressed, said socket contact having a notch therethrough at each end thereof transverse to and through said slot, and one member at least at one end of said socket contact fixed thereto, said one member having a stiffness greater than that of said socket contact, another member being fixed to the other end of said socket contact, said other member also having a stiffness greater than that of said socket contact.

3. An electrical connector comprising: a pin contact, said pin contact having a circular external surface portion of a predetermined uniform outside diameter therearound; and a hollow tube-like socket contact to receive said pin contact, said socket contact having a longitudinal slot therethrough at one angular position therearound, said socket contact having different stressed and unstressed inside diameters around the approximately symmetrical axis thereof at different angular positions such that when said pin contact is inserted into the interior of said socket contact, said socket contact engages and exerts pressure upon said pin contact at approximately diametrical opposite locations therearound at said one angular position, the unstressed inside diameter of said socket contact at said one angular position being smaller than said predetermined diameter, said socket contact being stressed when said pin contact is inserted thereinto, said socket contact having a notch therethrough at each end thereof transverse to and through said slot, and one member at least at one end of said socket contact fixed thereto, said one member having a stiffness greater than that of said socket contact, another member being fixed to the other end of said socket contact, said other member also having a stiffness greater than that of said socket contact.

4. An electrical connector comprising: a pin contact, said pin contact having a circular external surface portion of a predetermined uniform outside diameter therearound; and a hollow tube-like socket contact to receive said pin contact, said socket contact having a longitudinal slot therethrough at one angular position therearound, said socket contact having different stressed and unstressed inside diameters around the approximately symmetrical axis thereof at different angular positions such that when said pin contact is inserted into the interior of said socket contact, said socket contact engages and exerts pressure upon said pin contact at approximately diametrical opposite locations therearound at said one angular position, the unstressed inside diameter of said socket contact at said one angular position being smaller than said predetermined diameter, said socket contact being stressed when said pin contact is inserted thereinto, said socket contact having a notch therethrough at each end thereof transverse to and through said slot, and one member at least at one end of said socket contact fixed thereto, said one member having a stiffness greater than that of said socket contact, one inside diameter of said socket contact at a location about 90 degrees from said one angular position being larger than said predetermined diameter when said socket contact is unstressed, another member being fixed to the other end of said socket contact, said other member also having a stiffness greater than that of said socket contact.

* * * * *